US009301355B2

(12) United States Patent
Zhao

(10) Patent No.: US 9,301,355 B2
(45) Date of Patent: Mar. 29, 2016

(54) METHOD OF TAKING POWER WITH LOW-VOLTAGE BYPASS BY INTEGRATED CIRCUIT FOR AC DIRECT DRIVING LEDS AND THE INTEGRATED CIRCUIT

(71) Applicant: HEFEI SPRUCE OPTOELECTRONIC TECHNOLOGY CO., LTD., Hefei, Anhui (CN)

(72) Inventor: Tianpeng Zhao, Anhui (CN)

(73) Assignee: Hefei Spruce Optoelectronic Technology Co., Ltd., Hefei, Anhui (CN)

( * ) Notice: Subject to any disclaimer, the term of this patent is extended or adjusted under 35 U.S.C. 154(b) by 0 days.

(21) Appl. No.: 14/418,641

(22) PCT Filed: Feb. 26, 2014

(86) PCT No.: PCT/CN2014/072539
§ 371 (c)(1),
(2) Date: Jan. 30, 2015

(87) PCT Pub. No.: WO2014/173200
PCT Pub. Date: Oct. 30, 2014

(65) Prior Publication Data

US 2015/0208474 A1 Jul. 23, 2015

(30) Foreign Application Priority Data

Apr. 25, 2013 (CN) ..... 2013 1 0147248

(51) Int. Cl.
*H05B 33/08* (2006.01)

(52) U.S. Cl.
CPC ..... *H05B 33/0818* (2013.01); *H05B 33/083* (2013.01); *H05B 33/0827* (2013.01)

(58) Field of Classification Search
CPC ..... H05B 33/0818; H05B 33/0827; H05B 33/083
See application file for complete search history.

(56) References Cited

U.S. PATENT DOCUMENTS

2009/0085490 A1 4/2009 Awalt et al.

FOREIGN PATENT DOCUMENTS

CN 101668373 A 3/2010
CN 101827481 A 9/2010

(Continued)

OTHER PUBLICATIONS

International Search Report (ISA/CN) for International Application No. PCT/CN2014/072539, mailed May 28, 2014, 3 pages.

*Primary Examiner* — Tung X Le
*Assistant Examiner* — Raymond R Chai
(74) *Attorney, Agent, or Firm* — Foley & Lardner LLP; Antoinette F. Konski; Angela D. Murch

(57) ABSTRACT

Disclosed is a method of taking electric power from a low voltage bypass for providing low voltage power supply for an integrated circuit. Also provided is an alternating current (AC) directly driven LED integrated circuit adapted to use the method; the integrated circuit includes a voltage stabilizing circuit, a low voltage electronic switch circuit, an under-voltage control circuit, and a comparative amplification circuit, and has three pins, a positive power supply terminal, a zero potential reference terminal, and a common terminal for current sampling and for the low voltage electronic switch. The method of taking electric power from a low voltage bypass for providing low voltage power supply for an AC directly driven LED integrated circuit, and the integrated circuit adapted to use the method have the advantages of low power consumption and cost, high efficiency and reliability, and fewer pins and external devices, and are easy to use.

4 Claims, 2 Drawing Sheets

(56) References Cited

FOREIGN PATENT DOCUMENTS

| | | | | |
|---|---|---|---|---|
| CN | 102065598 | A | | 5/2011 |
| CN | 102740561 | | * | 10/2012 |
| CN | 102740561 | A | | 10/2012 |
| CN | 102821505 | A | | 12/2012 |
| CN | 202679724 | U | | 1/2013 |
| CN | 103052201 | A | | 4/2013 |
| CN | 202873127 | U | | 4/2013 |
| CN | 103209506 | A | | 7/2013 |
| CN | 203120227 | U | | 8/2013 |
| CN | 203219579 | U | | 9/2013 |
| EP | 2 469 984 | A2 | | 6/2012 |

* cited by examiner

METHOD OF TAKING POWER WITH LOW-VOLTAGE BYPASS BY INTEGRATED CIRCUIT FOR AC DIRECT DRIVING LEDS AND THE INTEGRATED CIRCUIT

CROSS-REFERENCE TO RELATED APPLICATIONS

This application is a U.S. national stage application under 35 U.S.C. §371 of International Application No. PCT/CN2014/072539, filed Feb. 26, 2014, which in turn claims the benefit of Chinese Application No. 201310147248.6, filed Apr. 25, 2013, the content of each of which is incorporated herein by reference in its entirety.

FIELD OF THE INVENTION

The present invention relates to electronics, and in particular, relates to a method of taking power with low-voltage bypass by an integrated circuit (IC) for alternating current (AC) direct driving LEDs and the IC.

BACKGROUND OF THE INVENTION

The technologies of AC direct driving light emitting diodes (LEDs) have attracted a wide attention for their characteristics of simple structure, low cost, long lifetime and the like, and IC for AC direct driving LEDs is the key technology. However, in the existing technologies of IC for AC direct driving LEDs, all methods of supplying power for the IC use a method of taking power directly from an AC high-voltage supply that converts mains high-voltage AC supply of 220V RMS (Root Mean Square) or 110V RMS into a low-voltage DC and supplies the low-voltage DC power to the IC, which mainly includes power resistor voltage drop, high voltage nonpolar large-capacity capacitor voltage drop, transformer and switching power supply, etc. The existing resistor voltage drop technology has an apparent disadvantage that the useless power dissipated on the voltage-dropping power resistor is large. The capacitor voltage drop technology has disadvantages of poor anti-surge performance, and low reliability. The transformer technology has disadvantages of low efficiency and large volume. The switching power supply technology has disadvantages of complex circuits and high cost. Moreover, such an AC high voltage power taking technology has an especially critical technical disadvantage that, in the practical application, a large number of long AC high-voltage circuit wires will cause difficulty in the wiring between LEDs and ICs on printed circuit board (PCB), an increase in the area of the PCB and lower reliability. Especially, for the chip on board (COB) technology that has been widely used and is continuously developing rapidly, namely, the technology of bonding LED chips and IC chips for AC direct driving LEDs on a ceramic or aluminum board, the existing AC high voltage power supplying technology for the IC for AC high voltage direct driving LEDs usually requires a large number of long and high-voltage connecting wires and electronic components with a high voltage of hundreds of volts, which significantly increases the area of the board for LED chips and IC chips, lowers the reliability of the products and increases the manufacturing cost.

SUMMARY OF THE INVENTION

The present invention provides a method of taking power with low-voltage bypass by an integrated circuit (IC) for AC direct driving LEDs, and the IC for AC direct driving LEDs that is suitable for applying the method of taking power with low-voltage bypass.

Provided here in is a method of taking power with low-voltage bypass by an IC for AC direct driving LEDs, wherein: the IC for AC direct driving LEDs comprises three pins, i.e., a positive power-supply terminal, a zero potential reference terminal and a common terminal for current sampling and low-voltage electronic switching; and a LEDs-load unit, comprising a group of LEDs, together with a current sampling resistor, is suitable for being provided external to the IC, wherein the LEDs-load unit comprises several or dozens of LEDs connected in series in the same direction, and has a positive end with a positive power-taking node and a negative end with a common terminal node for current sampling and low-voltage electronic switching, where the negative end is connected to one end of a current sampling resistor Rs, and the other end of the current sampling resistor Rs has a zero potential reference terminal node. The method of taking power by the IC or the usage of the IC comprises: connecting the positive power-supply terminal of the IC to the positive power-taking node of the LEDs-load unit; connecting the common terminal of the IC for current sampling and low-voltage electronic switching to the common terminal node of the LEDs-load unit for current sampling and low-voltage electronic switching; and connecting the zero potential reference terminal of the IC to the zero potential reference terminal node of the LEDs-load unit; so that a voltage obtained by the method is a unidirectional pulsating low voltage, wherein the unidirectional pulsating low voltage has a maximum peak voltage, typically 10V to 60V, which is equal to a transient voltage across the LEDs-load unit and is much lower than a peak voltage of AC mains, such as a peak voltage 311V of 220V (rms) AC mains, and has a frequency, such as 100 Hz or 120 Hz, twice of that of AC mains. The IC comprises a voltage stabilizing circuit, a low-voltage electronic switching circuit, an under-voltage control circuit and a comparing and amplifying circuit. The voltage stabilizing circuit has a stabilized output voltage of about 2.4V; the low-voltage electronic switching circuit functions to control switching-in or short-circuiting of the LEDs-load unit according to current intensity of a sampled current; the under-voltage control circuit has a threshold of about 3.0V, and is suitable for causing the low-voltage electronic switching circuit to become an open circuit so as to switch in the LEDs-load unit when a transient voltage across the IC obtained by taking power with the low-voltage bypass is lower than the threshold voltage; the comparing and amplifying circuit has a reference voltage of about 1.2V, and is suitable for outputting a control level to control switching of the low-voltage electronic switching circuit upon comparing and amplifying a voltage across the current sampling resistor with the reference voltage, so that the low-voltage electronic switching circuit switches in the LEDs-load unit when the voltage across the current sampling resistor is greater than the reference voltage, and the low-voltage electronic switching circuit short-circuits the LEDs-load unit when the voltage across the current sampling resistor is less than the reference voltage.

The method of taking power by the IC is a method of taking power with low-voltage bypass, comprising: connecting the positive power-supplied terminal of the IC to the positive power-taken node of the LEDs-load unit; connecting the common terminal of the IC for current sampling and low-voltage electronic switching to the common terminal node, of the LEDs-load unit, for current sampling and low-voltage electronic switching; and connecting the zero potential reference terminal of the IC to the zero potential reference terminal node of the LEDs-load unit; so that a voltage obtained by the method is a unidirectional pulsating low voltage, wherein the unidirectional pulsating low voltage has a maximum peak voltage, typically 10V to 60V, which is equal to a transient voltage across the LEDs-load unit and is much lower than a peak voltage of AC mains such as peak voltage 311V of 220V (rms) AC mains, and has a frequency, such as 100 Hz or 120 Hz, twice of that of AC mains.

The IC is an IC suitable for AC direct driving LEDs by taking power with low-voltage bypass, comprising a voltage stabilizing circuit 1, a low-voltage electronic switching circuit 2, an under-voltage control circuit 3 and a comparing and amplifying circuit 4, and provided with three pins, which are a positive power-supply terminal, a common terminal for current sampling and low-voltage electronic switching and a zero potential reference terminal, respectively. A unidirectional pulsating voltage of 10V to 60V is taken by the positive power supply terminal; the positive power-supply terminal is connected to each of the voltage stabilizing circuit 1, the low-voltage electronic switching circuit 2 and the under-voltage control circuit 3; an output of the voltage stabilizing circuit 1 is connected to an input end of the under-voltage control circuit 3; an output end of the under-voltage control circuit 3 is connected to an input end of the low-voltage electronic switching circuit 2; another output of the voltage stabilizing circuit 1 is connected to an input end of the comparing and amplifying circuit 4; an output end of the comparing and amplifying circuit 4 is connected to the input end of the low-voltage electronic switching circuit 2; the common terminal for current sampling and low-voltage electronic switching is connected both to the low-voltage electronic switching circuit 2 and to the comparing and amplifying circuit 4; the zero potential reference terminal is connected, by connecting the current sampling resistor Rs in series, with the common terminal for current sampling and low-voltage electronic switching; the voltage stabilizing circuit 1 supplies voltage-stabilized power to the comparing and amplifying circuit 4; the low-voltage electronic switching circuit 2 has two working states that correspond to switching-in and short-circuiting of the LEDs-load unit, respectively; the under-voltage control circuit 3 has a fixed threshold voltage, and is suitable for causing the low-voltage electronic switching circuit 2 to become an open circuit so as to switch in the LEDs-load unit when the transient voltage across the IC obtained by taking power with low-voltage bypass is lower than the threshold voltage of the under-voltage control circuit 3; the comparing and amplifying circuit 4 has two differential output terminals, of which a non-inverting output terminal is connected to the input end of the under-voltage control circuit 3 and an inverting output end is connected to the input control terminal of the low-voltage electronic switching circuit 2; and the comparing circuit 4 is provided with a reference voltage and amplifying the voltage difference, and is suitable for outputting a control level to control switching of the low-voltage electronic switching circuit 2 upon comparing and amplifying the voltage across the current sampling resistor with the reference voltage, so that the low-voltage electronic switching circuit 2 switches in the LEDs-load unit when the voltage across the current sampling resistor is greater than the reference voltage, and the low-voltage electronic switching circuit 2 short-circuits the LEDs-load unit when the voltage across the current sampling resistor is less than the reference voltage.

The voltage stabilizing circuit 1 comprises a transistor Q15, a transistor Q16, a transistor Q14, a transistor Q17, a transistor Q18, a transistor Q19, a transistor Q20, a transistor Q21 and a resistor R4. Emitter of the transistor Q15, emitter of the transistor Q16 and collector of the transistor Q14 each are connected to the positive power-supply terminal of the IC; base of the transistor Q15, base of the transistor Q16 and collector of the transistor Q16 each are connected to one end of the resistor R4, the other end of which is connected to the zero potential reference terminal of the IC; collector of the transistor Q15, base of the transistor Q14, base of the transistor Q17 and collector of the transistor Q17 are connected to one another; emitter of the transistor Q17, base of the transistor Q18 and collector of the transistor Q18 are connected to one another; emitter of the transistor Q18 is connected both to base of the transistor Q19 and to collector of the transistor Q19; emitter of the transistor Q19 is connected both to base of the transistor Q20 and to collector of the transistor Q20; emitter of the transistor Q20 is connected both to base of the transistor Q21 and to collector of the transistor Q21; and emitter of the transistor Q21 is connected to the zero potential reference terminal. The transistor Q15 and the transistor Q16 are PNP transistors, and the transistor Q14, the transistor Q17, the transistor Q18, the transistor Q19, the transistor Q20 and the transistor Q21 are NPN transistors.

The low-voltage electronic switching circuit 2 comprises a transistor Q23, a transistor Q25, a transistor Q26 and a transistor Q27. Emitter of the transistor Q23 is connected to the zero potential reference terminal, and collector of the transistor Q23 is connected both to collector of the transistor Q25 and to base of the transistor Q26; emitter of the transistor Q25, collector of the transistor Q26 and collector of the transistor Q27 are all connected to the positive power-supply terminal; emitter of the transistor Q26 is connected to base of the transistor Q27; and emitter of the transistor Q27 is connected to the common terminal for current sampling and low-voltage electronic switching. The transistor Q25 is a PNP transistor, and the transistor Q23, the transistor Q26 and the transistor Q27 are NPN transistors.

The under-voltage control circuit 3 comprises a transistor Q24 and a transistor Q22. Emitter of the transistor Q24 is connected to the positive power-supply terminal; base of the transistor Q24, collector of the transistor Q24 and collector of the transistor Q22 are connected to one another; and emitter of the transistor Q22 is connected to the zero potential reference terminal. The transistor Q24 is a PNP transistor, whereas the transistor Q22 is an NPN transistor.

The comparing and amplifying circuit 4 comprises a transistor Q1, a transistor Q2, a transistor Q3, a transistor Q4, a transistor Q10, a transistor Q11, a transistor Q5, a transistor Q6, a transistor Q7, a transistor Q8, a transistor Q9, a transistor Q12, a transistor Q13, a resistor R1, a resistor R2, a resistor R3 and a resistor R5. Base of the transistor Q1, base of the transistor Q2, base of the transistor Q11, base of the transistor Q10, collector of the transistor Q10 and one end of the resistor R3 are connected to one another; the other end of the resistor R3 is connected both to collector of the transistor Q9 and to base of the transistor Q9; collector of the transistor Q1, collector of the transistor Q2, emitter of the transistor Q3 and emitter of the transistor Q4 are connected to one another; base of the transistor Q3, collector of the transistor Q5 and one end of the resistor R1 are connected to one another; collector of the transistor Q3 is connected to the zero potential reference terminal; base of the transistor Q4, collector of the transistor Q6 and one end of the resistor R2 are connected to one another; emitter of the transistor Q5, emitter of the transistor Q6, collector of the transistor Q7 and collector of the transistor Q8 are connected to one another; base of the transistor Q5, collector of the transistor Q11, collector of the transistor Q12 and base of the transistor Q12 are connected to one another; emitter of the transistor Q12, collector of the transistor Q13 and base of the transistor Q13 are connected to one another; base of the transistor Q6 is connected to one end of the resistor R5, the other end of which is connected to the common terminal for current sampling and low-voltage electronic switching; base of the transistor Q7, base of the transistor Q8 and the base of the transistor Q9 are connected to one another; and emitter of the transistor Q13, emitter of the transistor Q7, emitter of the transistor Q8 and emitter of the transistor Q9 each are connected to the zero potential reference terminal. The transistor Q1, the transistor Q2, the transistor Q3, the transistor Q4, the transistor Q10 and the transistor Q11 are all PNP transistors, whereas the transistor Q5, the transistor Q6, the transistor Q7, the transistor Q8, the transistor Q9, the transistor Q12 and the transistor Q13 are all NPN transistors.

The above four function circuits are connected in a manner such that emitter of the transistor Q14 for stabilizing voltage output inside the voltage stabilizing circuit 1 offers voltage-stabilized output, and the emitter of the transistor Q14 is connected to each of emitter of the transistor Q1, emitter of the transistor Q2, emitter of the transistor Q10, emitter of the transistor Q11, the other end of the resistor R1 and the other end of the resistor R2 in the comparing and amplifying circuit 4; the base and the collector of the transistor Q21 in the voltage stabilizing circuit 1 are together connected to base of the transistor Q22 in the under-voltage control circuit 3; the collector of the transistor Q4 in the comparing and amplifying circuit 4 is connected to base of the transistor Q23 in the low-voltage switching control circuit 2; the other end of the resistor R5 in the comparing and amplifying circuit 4 is connected both to the emitter of the transistor Q27 of the low-voltage switching circuit 2 and to the common terminal for current sampling and low-voltage electronic switching; and the base and the emitter of the transistor Q24 in the under-voltage control circuit 3 are connected to each other and are then together connected to base of the transistor Q25 in the low-voltage electronic switching circuit 2.

The present invention has the following beneficial effects.

The present invention provides a method of taking power with low-voltage bypass by an IC for AC direct driving LEDs and the IC for AC direct driving LEDs that is suitable for applying the method of taking power with low-voltage bypass. The method of taking power with low-voltage bypass has the characteristics of simplicity in power-taking, low voltage and high efficiency, thus the areas of the board for LED chips and IC chips may be significantly reduced, and the reliability may be greatly improved. The IC of the present invention not only meets the requirements of low-voltage bypass power-taking technologies, but also has the advantages of low power consumption, high efficiency, high reliability, low cost, less pins, less external components and convenient use, etc.

DETAILED DESCRIPTION OF THE EMBODIMENTS

The present invention will be further described in conjunction with the accompanying drawings.

Embodiment 1

Figure 1:
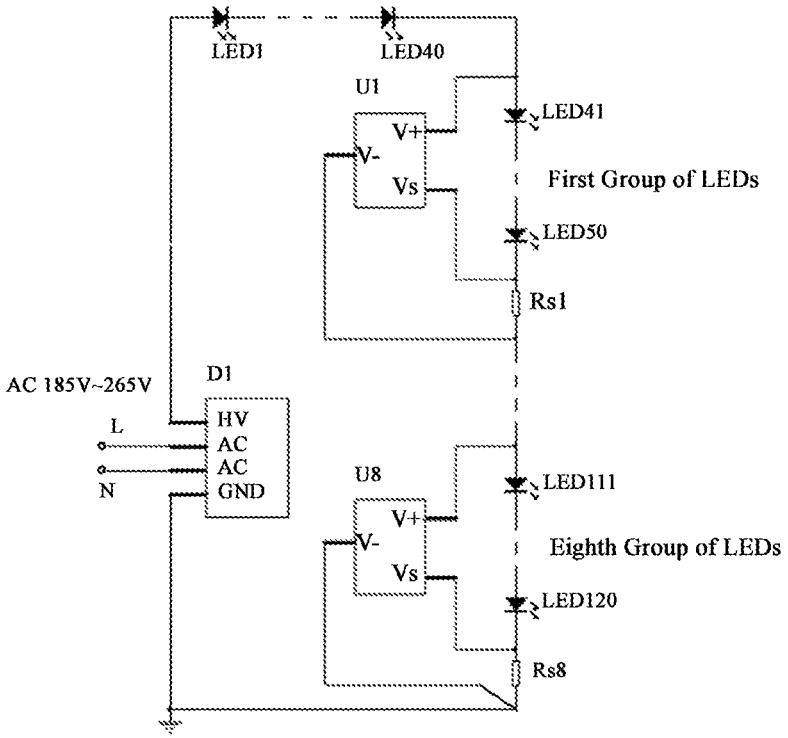
FIG. 1 shows a circuit diagram illustrating an application of an IC in accordance with the present invention along with a method of taking power with low-voltage bypass by the IC.

FIG. 1 shows a circuit diagram illustrating an application of an IC in accordance with the present invention along with a method of taking power with low-voltage bypass by the IC. The circuit diagram as shown by this figure includes: a bridge rectifier D1; eight ICs (from a first IC U1 to an eighth IC U8) in accordance with the present invention; a LEDs-load unit comprising forward biased LED1 to LED40 connected in series which are not controlled by the IC in accordance with the present invention and are always switched in; a LEDs-load unit comprising forward biased LED41 to LED50 connected in series which are controlled by the IC in accordance with the present invention; a first current sampling resistor Rs1 as an external current sampling resistor of the first IC U1; and, by analogy, tO an eighth controlled LEDs-load unit comprising an eighth group of forward biased LED111 to LED120 connected in series, along with an eighth current sampling resistor Rs8 as an external current sampling resistor of the eighth IC U8. AC mains with a frequency of 50 Hz and with a RMS voltage of 185V to 265V may be full-wave rectified via the bridge rectifier D1 to obtain a unidirectional pulsating voltage with a frequency of 100 Hz and with a peak voltage, i.e., about 261V to 375V, which is about 1.414 times higher than AC input RMS voltage. The resistances of the eight external sampling resistors (the first current sampling resistor Rs1 to the eighth current sampling resistor Rs8) corresponding to the eight ICs have resistance values having a stepwise distribution, which are 10Ω, 11Ω, 12Ω, 13Ω, 15Ω, 16Ω, 18Ω and 20Ω, respectively. Each of LED1 to LED120 has a rated operational current of 100 mA, and has a forward voltage of 3.5V under the rated operational current of 100 mA. In this embodiment, each of the ICs (i.e., the first IC U1 to the eighth IC U8) has three pins, i.e., a positive power-supply terminal V+, a zero potential reference terminal V− and a common terminal Vs for current sampling and low-voltage electronic switching.

As can be seen from FIG. 1, the method of taking power with low-voltage bypass in accordance with the present invention is illustrated as follows. The positive power-supply terminal V+ of the first IC U1 is connected to a positive electrode of the LED41. The LED41 to LED50 are forward biased and connected in series. The negative electrode of the LED50 is connected both to one end of the current sampling resistor Rs1 and to the common terminal Vs for current sampling and low-voltage electronic switching of the first IC U1. The other end of the Rs1 is connected to the zero potential reference terminal V− of the first IC U1. The supply voltage of the IC U1 is also a unidirectional pulsating voltage with a frequency of 100 Hz, the peak value of which is equal to a transient voltage across the first controlled LEDs-load unit (LED41 to LED50 being forward biased and connected in series) and the sampling resistor R1. When the low-voltage electronic switch of the first IC U1 is in an open-circuit state, the first controlled LEDs-load unit (LED41 to LED50 being forward biased and connected in series) which is controlled by the first IC U1 will be correspondingly in a switched-in state with a forward voltage of about 35V, where a voltage drop across the sampling resistor Rs1 is about 1.0V, and the voltage of power taken with low-voltage bypass by the IC U1 has a frequency of 100 Hz, and has a peak voltage of 36V.

When the low-voltage electronic switch of the first IC U1 is in a short-circuited state, this first controlled LEDs-load unit (LED41 to LED50 being connected in forward series) which is controlled by the first IC U1 will be correspondingly in a short-circuited state with a short-circuit voltage drop of about 2.0V, where a voltage drop across the sampling resistor Rs1 is about 1.0V and the voltage of power taken with low-voltage bypass by the IC U1 is less than or equal to 3.0V.

The circuit illustrated by FIG. 1 is an 8-stage-switch-controlled circuit for AC direct driving LEDs, in which the ICs of the present invention are applied. In the circuit, the first IC U1 to the eighth IC U8 are eight ICs in accordance with the present invention, each of which is supplied by taking power with the low-voltage bypass, and controls switching between switching-in and short-circuiting of the corresponding one group of eight groups of LEDs connected in series in the same direction, respectively. It is especially important that the resistances of the eight external current sampling resistors (i.e., the first current sampling resistor Rs1 to the eighth current sampling resistor Rs8) external to the eight ICs have different resistance values having a stepwise distribution, for example, 10Ω, 11Ω, 12Ω, 13Ω, 15Ω, 16Ω, 18Ω and 20Ω, respectively.

The 8-stage-switch-controlled circuit for AC direct driving LEDs, in which the ICs of the present invention are applied, has the main technical specifications as follows: AC input voltage in the range of 185V (rms) to 265V (rms); and efficiency of the driving circuit greater than 94%, Power Factor (PF) of greater than 0.96 and Total Harmonic Distortion (THD) of less than 25%, under the AC input voltage of 220V (rms).

Embodiment 2

Figure 2:
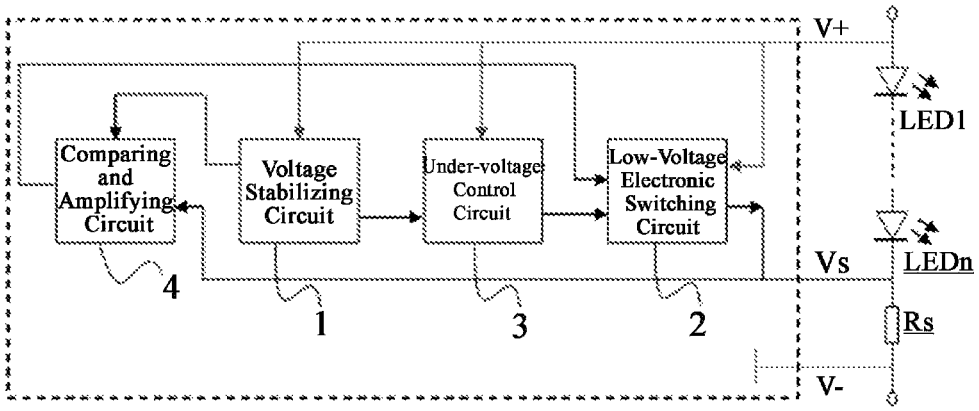
FIG. 2 shows a block diagram illustrating a circuit configuration of the IC in accordance with the present invention.

FIG. 2 shows a block diagram illustrating a circuit configuration of the IC in accordance with the present invention. The IC comprises a voltage stabilizing circuit 1, a low-voltage electronic switching circuit 2, an under-voltage control circuit 3 and a comparing and amplifying circuit 4. The IC has three pins, i.e., a positive power-supply terminal V+, a common terminal Vs for current sampling and low-voltage electronic switching, and a zero potential reference terminal V−. The LED1 to LEDN connected in series in the same direction represent external loads, forming an external LEDs-load unit. Rs represents an external current sampling resistor of the IC. The voltage stabilizing circuit 1 has an input voltage corresponding to V+ for the IC, and has an output voltage of about 2.4V, which supplies power to the comparing and amplifying circuit 4. The voltage stabilizing circuit provides a low level output under an under-voltage input, and is connected to the input end of the under-voltage control circuit 3. The output end of the under-voltage control circuit 3 is connected with an input terminal of the low-voltage electronic switching circuit 2. When V+ is lower than 3.0V, the low-voltage electronic switching circuit 2 will remain in an open-circuit state so that the external LEDs-load unit is in a switched-in state. The input end of the comparing and amplifying circuit 4 and a switching control terminal of the low-voltage electronic switching circuit 2 are connected to each other, as the common terminal Vs of the IC for current sampling and low-voltage electronic switching. The output end of the comparing and amplifying circuit 4 is connected to another input terminal of the low-voltage electronic switching 2. The comparing and amplifying circuit 4 outputs a high level or a low level depending on the value of the voltage across the current sampling resistor, and the low-voltage electronic switching circuit 2 controls switching between switching-in and short-circuiting of the external LEDs-load unit.

Embodiment 3

Figure 3:
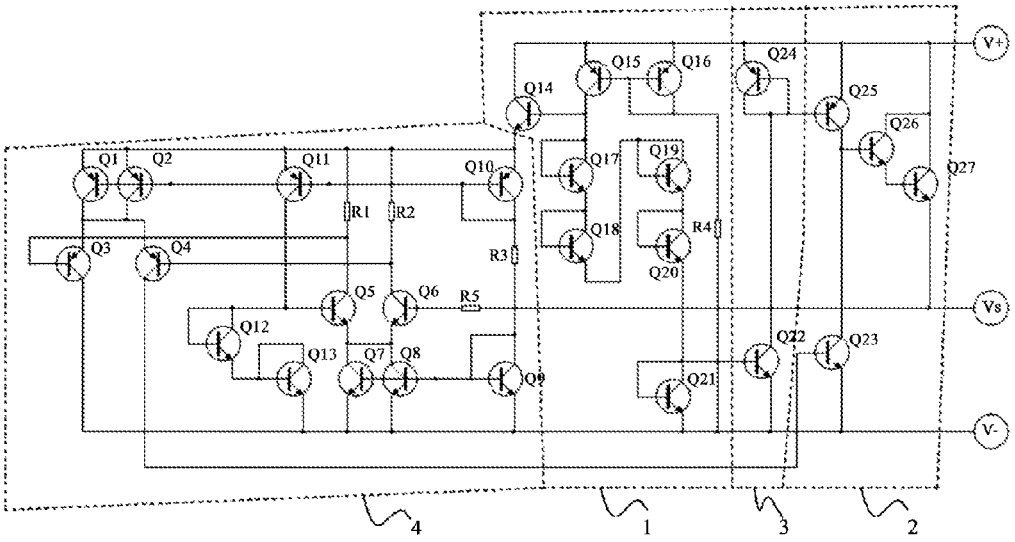
FIG. 3 shows an internal circuit diagram of a bipolar IC in accordance with the present invention.

FIG. 3 shows an internal circuit diagram of the IC in accordance with the present invention applying a bipolar IC technology, which is an internal circuit diagram of an IC that is compatible with a bipolar IC technology. As shown in FIG. 3, the IC is an IC for AC direct driving LEDs suitable for taking power with low-voltage bypass, comprising a voltage stabilizing circuit 1, a low-voltage electronic switching circuit 2, an under-voltage control circuit 3 and a comparing and amplifying circuit 4, and provided with three pins, i.e., a positive power-supplied terminal, a common terminal for current sampling and low-voltage electronic switching, and a zero potential reference terminal. The positive power-supply terminal is connected to each of the voltage stabilizing circuit 1, the low-voltage electronic switching circuit 2 and the under-voltage control circuit 3; an output of the voltage stabilizing circuit 1 is connected to an input end of the under-voltage control circuit 3, the output end of which is connected to an input end of the low-voltage electronic switching circuit 2; another output of the voltage stabilizing circuit 1 is connected to the input end of the comparing and amplifying circuit 4, the output end of which is connected to the input end of the low-voltage electronic switching circuit 2; the common terminal for current sampling and low-voltage electronic switching is connected both to the low-voltage electronic switching circuit 2 and to the comparing and amplifying circuit 4; and the zero potential reference terminal is connected, by connecting the current sampling resistor Rs in series, with the common terminal for current sampling and low-voltage electronic switching. The voltage stabilizing circuit 1 supplies voltage-stabilized power to the comparing and amplifying circuit 4. The low-voltage electronic switching circuit 2 has two working states that correspond to switching-in and short-circuiting of the LEDs load, respectively. The under-voltage control circuit 3 has a fixed threshold voltage, and causes the low-voltage electronic switching circuit 2 to become an open circuit so as to switch in the corresponding LEDs-load unit when the transient voltage across the IC obtained by taking power with low-voltage bypass is lower than the threshold voltage of the under-voltage control circuit 3. The comparing and amplifying circuit 4 has two differential output terminals, a non-inverting output terminal of which is connected to the input terminal of the under-voltage control circuit 3 and an inverting output end of which is connected to the input control terminal of the low-voltage electronic switching circuit 2. The comparing and amplifying circuit 4 is provided with a reference voltage, and outputs a control level to control switching of the low-voltage electronic switching circuit 2 upon comparing the voltage across the current sampling resistor with the reference voltage and amplifying the voltage differential. When the voltage across the current sampling resistor is greater than the reference voltage, the low-voltage electronic switching circuit 2 switches in the LEDs-load unit, and when the voltage across the current sampling resistor is less than the reference voltage, the low-voltage electronic switching circuit 2 short-circuits the LEDs-load unit.

The voltage stabilizing circuit 1 includes a transistor Q15, a transistor Q16, a transistor Q14, a transistor Q17, a transistor Q18, a transistor Q19, a transistor Q20, a transistor Q21 and a resistor R4. Emitter of the transistor Q15, emitter of the transistor Q16 and collector of the transistor Q14 are all connected to the positive power-supplied terminal of the IC;

base of the transistor Q15, base of the transistor Q16 and collector of the transistor Q16 each are connected to one end of the resistor R4, the other end of which is connected to the zero potential reference terminal of the IC; collector of the transistor Q15, base of the transistor Q14, base of the transistor Q17 and collector of the transistor Q17 are connected to one another; emitter of the transistor Q17, base of the transistor Q18 and collector of the transistor Q18 are connected to one another; emitter of the transistor Q18 is connected both to base of the transistor Q19 and to collector of the transistor Q19; emitter of the transistor Q19 is connected both to base of the transistor Q20 and to collector of the transistor Q20; emitter of the transistor Q20 is connected both to base of the transistor Q21 and to collector of the transistor Q21; and emitter of the transistor Q21 is connected to the zero potential reference terminal. The transistor Q15 and the transistor Q16 are PNP transistors, and the transistor Q14, the transistor Q17, the transistor Q18, the transistor Q19, the transistor Q20 and the transistor Q21 are NPN transistors.

The low-voltage electronic switching circuit 2 includes a transistor Q23, a transistor Q25, a transistor Q26 and a transistor Q27. Emitter of the transistor Q23 is connected to the zero potential reference terminal, collector of the transistor Q23 is connected both to collector of the transistor Q25 and to base of the transistor Q26; emitter of the transistor Q25, collector of the transistor Q26 and collector of the transistor Q27 are all connected to the positive power-supplied terminal; emitter of the transistor Q26 is connected to base of the transistor Q27; and emitter of the transistor Q27 is connected to the common terminal for current sampling and low-voltage electronic switching. The transistor Q25 is a PNP transistor, and the transistor Q23, the transistor Q26 and the transistor Q27 are NPN transistors.

The under-voltage control circuit 3 includes a transistor Q24 and a transistor Q22, wherein emitter of the transistor Q24 is connected to the positive power-supplied terminal; base of the transistor Q24, collector of the transistor Q24 and collector of the transistor Q22 are connected to one another; and emitter of the transistor Q22 is connected to the zero potential reference terminal. The transistor Q24 is a PNP transistor, whereas the transistor Q22 is an NPN transistor.

The comparing and amplifying circuit 4 includes a transistor Q1, a transistor Q2, a transistor Q3, a transistor Q4, a transistor Q10, a transistor Q11, a transistor Q5, a transistor Q6, a transistor Q7, a transistor Q8, a transistor Q9, a transistor Q12, a transistor Q13, a resistor R1, a resistor R2, a resistor R3 and a resistor R5. Base of the transistor Q1, base of the transistor Q2, base of the transistor Q11, base of the transistor Q10, collector of the transistor Q10 and one end of the resistor R3 are connected to one another; the other end of the resistor R3 is connected both to collector of the transistor Q9 and to base of the transistor Q9; collector of the transistor Q1, collector of the transistor Q2, emitter of the transistor Q3 and emitter of the transistor Q4 are connected to one another; base of the transistor Q3, collector of the transistor Q5 and one end of the resistor R1 are connected to one another; collector of the transistor Q3 is connected to the zero potential reference terminal; base of the transistor Q4, collector of the transistor Q6 and one end of the resistor R2 are connected to one another; emitter of the transistor Q5, emitter of the transistor Q6, collector of the transistor Q7 and collector of the transistor Q8 are connected to one another; base of the transistor Q5, collector of the transistor Q11, collector of the transistor Q12 and base of the transistor Q12 are connected to one another; emitter of the transistor Q12, collector of the transistor Q13 and base of the transistor Q13 are connected to one another; base of the transistor Q6 is connected to one end of the resistor R5, the other end of which is connected to the common terminal for current sampling and low-voltage electronic switching; base of the transistor Q7, base of the transistor Q8 and base of the transistor Q9 are connected to one another; and emitter of the transistor Q13, emitter of the transistor Q7, emitter of the transistor Q8 and emitter of the transistor Q9 each are connected to the zero potential reference terminal. The transistor Q1, the transistor Q2, the transistor Q3, the transistor Q4, the transistor Q10 and the transistor Q11 are all PNP transistors, whereas the transistor Q5, the transistor Q6, the transistor Q7, the transistor Q8, the transistor Q9, the transistor Q12 and the transistor Q13 are all NPN transistors.

The above four function circuits are connected in the following manner. Emitter of the transistor Q14 for stabilizing voltage output inside the voltage stabilizing circuit 1 offers voltage-stabilized output, and the emitter of the transistor Q14 is connected to each of emitter of the transistor Q1, emitter of the transistor Q2, emitter of the transistor Q10 and emitter of the transistor Q11, the other end of the resistor R1 and the other end of the resistor R2 in the comparing and amplifying circuit 4. The base and the collector of the transistor Q21 in the voltage stabilizing circuit 1 are together connected to base of the transistor Q22 in the under-voltage control circuit 3. The collector of the transistor Q4 in the comparing and amplifying circuit 4 is connected to base of the transistor Q23 in the low-voltage switching control circuit 2. The other end of the resistor R5 in the comparing and amplifying circuit 4 is connected both to the emitter of the transistor Q27 of the low-voltage switching circuit 2 and to the common terminal for current sampling and low-voltage electronic switching. The base and the emitter of the transistor Q24 in the under-voltage control circuit 3 are connected to each other and then are together connected to base of the transistor Q25 in the low-voltage electronic switching circuit 2.

The resistor R1 has a resistance of 50KΩ; the resistor R2 has a resistance of 50KΩ; the resistor R3 has a resistance of 50KΩ; the resistor R4 has a resistance of 300KΩ; and the resistor R5 has a resistance of 2KΩ. The IC has a working voltage in a range of typically 0V to 60V. The 8-stage-switch-controlled circuit for AC direct driving LEDs by taking power with low-voltage bypass, which comprises the IC of the present invention, has the following main technical specifications: AC input voltage in the range of 185V (rms) to 265V (rms); and driving circuit having efficiency of greater than 94%, PF of greater than 0.96 and THD of less than 25%, under 220V (rms) AC input.

Embodiment 4

Figure 4:
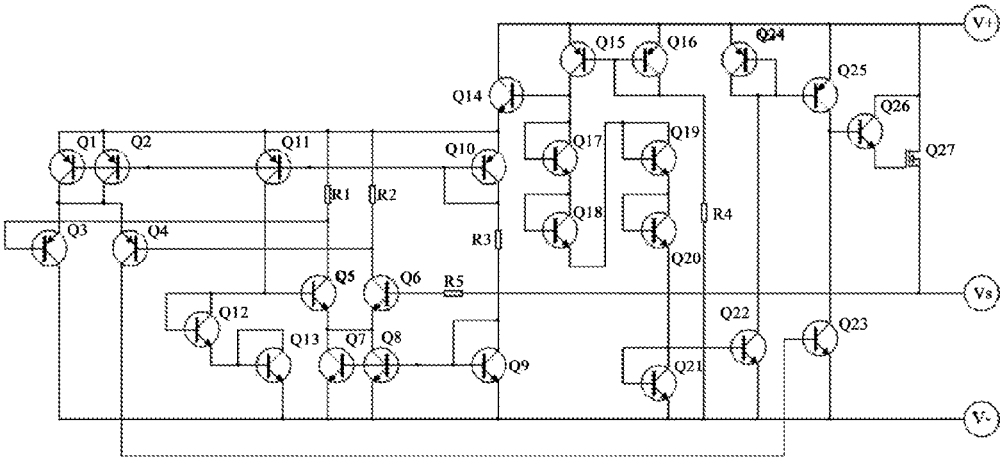
FIG. 4 shows an internal circuit diagram of a BiCMOS IC in accordance with the present invention.

FIG. 4 shows an internal circuit diagram of an IC in accordance with the present invention applying a BiCMOS IC technology. In comparison with the FIG. 3 of Embodiment 3, the IC shown by FIG. 4 has the same circuit configuration, except for the transistor Q27 as Metal-Oxide-Semiconductor Field-Effect Transistor (MOSFET) in replace of the transistor Q27 as NPN transistor, and has an internal circuit compatible with the BiCMOS technology. Since drain-to-source turn-on voltage of a MOSFET is typically lower than Collector-Emitter (CE) saturation voltage of a bipolar transistor, this IC of the present invention has higher circuit efficiency, but is fabricated with a relatively complex technology and a higher manufacturing cost. The IC has a working voltage in the range of typically 0V to 60V. The 8-stage-switch-controlled circuit for AC direct driving an LED by taking power with low-voltage bypass, which comprises the ICs of the present invention, has the following main technical specifications: AC input voltage in the range of 185V (rms) to 265V (rms); and efficiency of the driving circuit greater than 96%, PF of greater than 0.96 and THD of less than 25%, under 220V (rms) AC input.

What is claimed is:

1. A method of taking power with low-voltage bypass by an integrated circuit (IC) for AC direct driving of a LEDs-load unit, wherein: the IC for AC direct driving the LEDs-load unit is provided to have three pins, a positive power-supplied terminal, a zero potential reference terminal and a common terminal for current sampling and low-voltage electronic switching; and the LEDs-load unit, includes a group of LEDs, together with a current sampling resistor, is suitable for being provided external to the IC, wherein the LED group, includes a plurality of LEDs connected in series in the same direction, and has a positive end with a positive power-taken node and a negative end with a common terminal node for current sampling and low-voltage electronic switching, wherein the negative end is connected to one end of the current sampling resistor (Rs), and the other end of the current sampling resistor has a zero potential reference terminal node;

wherein the IC includes a voltage stabilizing circuit configured to have a stabilized output voltage of 2.4V; a low-voltage electronic switching circuit configured to function to control switching-in or short-circuiting of the LEDs-load unit according to current intensity of a sampled current; an under-voltage control circuit configured to have a threshold voltage of 3.0V, and be suitable for causing the low-voltage electronic switching circuit to become an open circuit so as to switch in the LEDs-load unit when a transient voltage across the IC obtained by taking power with the low-voltage bypass is lower than the threshold voltage; and a comparing and amplifying circuit configured to have a reference voltage of 1.2V, and be suitable for outputting a control level to control switching of the low-voltage electronic switching circuit upon comparing and amplifying a voltage across the current sampling resistor with the reference voltage, so that the low-voltage electronic switching circuit switches in the LEDs-load unit when the voltage across the current sampling resistor is greater than the reference voltage, and the low-voltage electronic switching circuit short-circuits the LEDs-load unit when the voltage across the current sampling resistor is less than the reference voltage, the method comprising: connecting the positive power-supplied terminal of the IC to the positive power-taken node of the LEDs-load unit; connecting the common terminal of the IC for current sampling and low-voltage electronic switching to the common terminal node, of the LEDs-load unit, for current sampling and low-voltage electronic switching; and connecting the zero potential reference terminal of the IC to the zero potential reference terminal node of the LEDs-load unit, so that a voltage obtained by the method is a unidirectional pulsating low voltage, wherein the unidirectional pulsating low voltage has a peak voltage, which is equal to a maximum transient voltage across the LEDs-load unit, is less than a peak voltage of AC, and has a frequency twice of that of AC mains.

2. The method according to claim 1, wherein the maximum peak voltage of the unidirectional pulsating low voltage is 10V to 60V and the frequency of the unidirectional pulsating low voltage is 100 Hz or 120 Hz, and the peak voltage of AC mains is the peak voltage 311V of 220V(rms) AC mains.

3. An IC for AC direct driving LEDs by taking power with low-voltage bypass, comprising a voltage stabilizing circuit (1), a low-voltage electronic switching circuit (2), an under-voltage control circuit (3) and a comparing and amplifying circuit (4), and provided with three pins, which are a positive power-supplied terminal, a common terminal for current sampling and low-voltage electronic switching and a zero potential reference terminal, respectively, wherein: the positive power-supplied terminal is connected to each of the voltage stabilizing circuit (1), the low-voltage electronic switching circuit (2) and the under-voltage control circuit (3); an output of the voltage stabilizing circuit (1) is connected to an input end of the under-voltage control circuit (3); an output end of the under-voltage control circuit (3) is connected to an input end of the low-voltage electronic switching circuit (2); another output of the voltage stabilizing circuit (1) is connected to an input end of the comparing and amplifying circuit (4); an output end of the comparing and amplifying circuit (4) is connected to the input end of the low-voltage electronic switching circuit (2); the common terminal for current sampling and low-voltage electronic switching is connected both to the low-voltage electronic switching circuit (2) and to the comparing and amplifying circuit (4); the zero potential reference terminal is connected, by being connected to the current sampling resistor (Rs) in series, with the common terminal for current sampling and low-voltage electronic switching; the voltage stabilizing circuit (1) supplies voltage-stabilized power to the comparing and amplifying circuit (4); the low-voltage electronic switching circuit (2) has two working states that correspond to switched-in and short-circuited of the LEDs-load unit, respectively; the under-voltage control circuit (3) has a fixed threshold voltage, and is suitable for causing the low-voltage electronic switching circuit (2) to become an open circuit so as to switch in the corresponding LEDs-load unit when the transient voltage across the IC obtained by taking power with low-voltage bypass is lower than the threshold voltage of the under-voltage control circuit (3); the comparing and amplifying circuit (4) has two differential output terminals, of which a non-inverting output terminal is connected to the input end of the under-voltage control circuit (3) and an inverting output end is connected to the input control terminal of the low-voltage electronic switching circuit (2); the comparing and amplifying circuit (4) is provided with a reference voltage, and is suitable for outputting a control level to control switching of the low-voltage electronic switching circuit (2) upon comparing the voltage and amplifying across the current sampling resistor with the reference voltage, so that the low-voltage electronic switching circuit (2) switches in the LEDs-load unit when the voltage across the current sampling resistor is greater than the reference voltage, and the low-voltage electronic switching circuit (2) short-circuits the LEDs-load unit when the voltage across the current sampling resistor is less than the reference voltage, wherein the voltage stabilizing circuit (1) comprises a fourteenth transistor (Q14), a fifteenth transistor (Q15), a sixteenth transistor (Q16), a seventeenth transistor (Q17), a eighteenth transistor (Q18), a nineteenth transistor (Q19), a twentieth transistor (Q20), a twenty-first transistor (Q21) and a fourth resistor (R4), wherein: emitter of the fifteenth transistor (Q15), emitter of the sixteenth transistor (Q16) and collector of the fourteenth transistor (Q14) each are connected to the positive power-supplied terminal of the IC; base of the fifteenth transistor (Q15), base of the sixteenth transistor (Q16) and collector of the sixteenth transistor (Q16) each are connected to one end of the fourth resistor (R4), the other end of which is connected to the zero potential reference terminal of the IC; collector of the fifteenth transistor (Q15), base of the fourteenth transistor (Q14), base of the seventeenth transistor (Q17) and collector of the seventeenth transistor (Q17) are connected to one another; emitter of the seventeenth transistor (Q17), base of the eighteenth transistor (Q18) and collector of the eighteenth transistor (Q18) are connected to one another; emitter of the eighteenth transistor (Q18) is connected both to base of the nineteenth transistor (Q19) and to collector of the nineteenth transistor (Q19); emitter of the nineteenth transistor (Q19) is connected both to base of the twentieth transistor (Q20) and to collector of the twentieth transistor (Q20); emitter of the twentieth transistor (Q20) is connected both to base of the twenty-first transistor (Q21) and to collector of the twenty-first transistor (Q21); and emitter of the twenty-first transistor (Q21) is connected to the zero potential reference terminal; and wherein the fifteenth transistor (Q15) and the sixteenth transistor (Q16) each are a PNP transistor, and the fourteenth transistor (Q14), the seventeenth transistor (Q17), the eighteenth transistor (Q18), the nineteenth transistor (Q19), the twentieth transistor (Q20) and the twenty-first transistor (Q21) each are an NPN transistor;

wherein the low-voltage electronic switching circuit (2) comprises a twenty-third transistor (Q23), a twenty-fifth transistor (Q25), a twenty-sixth transistor (Q26) and a twenty-seventh transistor (Q27), wherein: emitter of the twenty-third transistor (Q23) is connected to the zero potential reference terminal, and collector of the twenty-third transistor (Q23) is connected both to collector of the twenty-fifth transistor (Q25) and to base of the twenty-sixth transistor (Q26); emitter of the twenty-fifth transistor (Q25), collector of the twenty-sixth transistor (Q26) and collector of the twenty-seventh transistor (Q27) are all connected to the positive power-supplied terminal; emitter of the twenty-sixth transistor (Q26) is connected to base of the twenty-seventh transistor (Q27); and emitter of the twenty-seventh transistor (Q27) is connected to the common terminal for current sampling and low-voltage electronic switching; and wherein the twenty-fifth transistor (Q25) is a PNP transistor, and the twenty-third transistor (Q23), the twenty-sixth transistor (Q26) and the twenty-seventh transistor (Q27) each are an NPN transistor;

wherein the under-voltage control circuit (3) comprises a twenty-fourth transistor (Q24) and a twenty-second transistor (Q22), wherein: emitter of the twenty-fourth transistor (Q24) is connected to the positive power-supplied terminal; base of the twenty-fourth transistor (Q24), collector of the twenty-fourth transistor (Q24) and collector of the twenty-second transistor (Q22) are connected to one another; and emitter of the twenty-second transistor (Q22) is connected to the zero potential reference terminal; and wherein the twenty-fourth transistor (Q24) is a PNP transistor, whereas the twenty-second transistor (Q22) is an NPN transistor;

wherein the comparing and amplifying circuit (4) comprises a first transistor (Q1), a second transistor (Q2), a third transistor (Q3), a fourth transistor (Q4), a tenth transistor (Q10), an eleventh transistor (Q11), a fifth transistor (Q5), a sixth transistor (Q6), a seventh transistor (Q7), a eighth transistor (Q8), a ninth transistor (Q9), twelfth transistor (Q12), a thirteenth transistor (Q13), a first resistor (R1), a second resistor (R2), a third resistor (R3) and a fifth resistor (R5), wherein: base of the first transistor (Q1), base of the second transistor (Q2), base of the first transistor (Q1)1, base of the tenth transistor (Q10), collector of the tenth transistor (Q10) and one end of the third resistor (R3) are connected to one another; the other end of the third resistor (R3) is connected both to collector of the ninth transistor (Q9) and to base of the ninth transistor (Q9); collector of the first transistor (Q1), collector of the second transistor (Q2), emitter of the third transistor (Q3) and emitter of the fourth transistor (Q4) are connected to one another; base of the third transistor (Q3), collector of the fifth transistor (Q5) and one end of the first resistor (R1) are connected to one another; collector of the third transistor (Q3) is connected to the zero potential reference terminal; base of the fourth transistor (Q4), collector of the sixth transistor (Q6) and one end of the second resistor (R2) are connected to one another; emitter of the fifth transistor (Q5), emitter of the sixth transistor (Q6), collector of the seventh transistor (Q7) and collector of the eighth transistor (Q8) are connected to one another; base of the fifth transistor (Q5), collector of the first transistor (Q1)1, collector of the twelfth transistor (Q12) and base of the twelfth transistor (Q12) are connected to one another; emitter of the twelfth transistor (Q12), collector of the thirteenth transistor (Q13) and base of the thirteenth transistor (Q13) are connected to one another; base of the sixth transistor (Q6) is connected to one end of the fifth resistor (R5), the other end of which is connected to the common terminal for current sampling and low-voltage electronic switching; base of the seventh transistor (Q7), base of the eighth transistor (Q8) and the base of the ninth transistor (Q9) are connected to one another; and emitter of the thirteenth transistor (Q13), emitter of the seventh transistor (Q7), emitter of the eighth transistor (Q8) and emitter of the ninth transistor (Q9) each are connected to the zero potential reference terminal; and wherein the first transistor (Q1), the second transistor (Q2), the third transistor (Q3), the fourth transistor (Q4), the tenth transistor (Q10) and the first transistor (Q1)1 are all PNP transistors, whereas the fifth transistor (Q5), the sixth transistor (Q6), the seventh transistor (Q7), the eighth transistor (Q8), the ninth transistor (Q9), the twelfth transistor (Q12) and the thirteenth transistor (Q13) are all NPN transistors; and wherein the connections between the above four function circuits are achieved in the manner that emitter of the fourteenth transistor (Q14) functioning as stabilization of voltage output inside the voltage stabilizing circuit (1) offers voltage-stabilized output, and the emitter of the fourteenth transistor (Q14) is connected to each of emitter of the first transistor (Q1), emitter of the second transistor (Q2), emitter of the tenth transistor (Q10), emitter of the first transistor (Q1)1, the other end of the first resistor (R1) and the other end of the second resistor (R2) in the comparing and amplifying circuit (4); the base and the collector of the twenty-first transistor (Q21) in the voltage stabilizing circuit (1) are together connected to base of the twenty-second transistor (Q22) in the under-voltage control circuit (3); the collector of the fourth transistor (Q4) in the comparing and amplifying circuit (4) is connected to base of the twenty-third transistor (Q23) in the low-voltage switching control circuit (2); the other end of the fifth resistor (R5) in the comparing and amplifying circuit (4) is connected both to the emitter of the twenty-seventh transistor (Q27) of the low-voltage switching circuit (2) and to the common terminal for current sampling and low-voltage electronic switching; and the base and the emitter of the twenty-fourth transistor (Q24) in the under-voltage control circuit (3) are connected to each other and are then together connected to base of the twenty-fifth transistor (Q25) in the low-voltage electronic switching circuit (2).

4. The IC according to claim 3, wherein the twenty-seventh transistor (Q27) is a MOSFET.

* * * * *